United States Patent [19]

Aschauer

[11] 4,316,722

[45] Feb. 23, 1982

[54] PROPULSION SYSTEM FOR SUBMARINE

[75] Inventor: George R. Aschauer, Racine, Wis.

[73] Assignee: Twin Disc, Incorporated, Racine, Wis.

[21] Appl. No.: 110,676

[22] Filed: Jan. 9, 1980

[51] Int. Cl.[3] ..... B63B 35/00

[52] U.S. Cl. ..... 440/74; 114/269; 60/435; 440/49; 440/83; 440/5

[58] Field of Search ..... 180/165, 305, 307; 114/269; 440/5, 4, 75, 83, 74, 88, 89; 188/290, 296; 192/3.34, 3.33, 13 R, 4 R, 4 B; 60/412, 435, 439, 440; 74/645, 730, 664

[56] References Cited

U.S. PATENT DOCUMENTS

| | | | |
|---|---|---|---|
| 1,551,529 | 8/1925 | MacMillian | 440/74 |
| 3,319,746 | 5/1967 | Christenson | 188/296 |
| 3,407,600 | 10/1968 | Meyer | 440/5 |
| 3,557,743 | 1/1971 | Rubis | 440/74 |
| 3,989,127 | 11/1976 | Stavdenmaier | 188/296 |
| 4,015,482 | 4/1977 | Ito | 60/435 |
| 4,098,144 | 7/1978 | Besel | 180/165 |

*Primary Examiner*—Trygve M. Blix

*Assistant Examiner*—D. W. Keen

*Attorney, Agent, or Firm*—James E. Nilles

[57] ABSTRACT

A low noise level, rapidly reversible propulsion system for a submarine or other vessel comprises a non-reversible adjustable speed prime mover, a reversible drive mechanism driven by the prime mover and including a fluid-cooled torque converter and speed reduction apparatus, an energy-dissipating load selectively connectable to the reversible drive mechanism, and a propeller driven by the reversible drive mechanism. Assuming forward submarine travel, rapid direction reversal is achieved by slowing the prime mover to idle, connecting the load to dissipate kinetic energy from the reversible drive mechanism and propeller, reversing the reversible drive mechanism when the system comes to slow speed or to rest to permit propeller rotation caused by forward submarine travel to drive the drive mechanism and torque converter in reverse, disconnecting the load, and increasing the speed of the prime mover to stop and then reverse the propeller and the direction of submarine travel, with the fluid-cooled torque converter dissipating in the form of heat the energy produced in bringing the propeller and submarine to a stop.

21 Claims, 6 Drawing Figures

PROPELLER TORQUE VERSUS PROPELLER SPEED AND HULL VELOCITY

PROPULSION SYSTEM FOR SUBMARINE

BACKGROUND OF THE INVENTION

Field of Use

This invention relates generally to low noise level, rapidly reversible main propulsion systems for marine vessels, such as submarines.

Description of the Prior Art

Some large marine vessels, including nuclear powered submarines and other types of ships, employ a nuclear powered steam generating plant which supplies steam to drive a prime mover, in the form of a large steam turbine, which in turn drives a drive mechanism which is connected to drive the propeller. Typically, the steam turbine operates at variable speeds and is reversible and the drive mechanism includes speed reduction gearing. The speed reduction gearing, especially the first stage gear elements thereof which operate at the highest speed, have a high noise signature which is undesirable in the case of submarines and other naval vessels because it facilitates detection and location by underwater sound detecting search gear. In addition, because of the great mass and high operational speeds of the ship itself, the turbine, the drive mechanism and the propeller, much time and distance is required for stopping and reversing the direction of travel of the vessel during maneuvers because of the large amounts of kinetic energy which must be dissipated before the vessel can be stopped, whereas it is desirable for example to be able to stop within five ship lengths.

SUMMARY OF THE INVENTION

The present invention provides an improved propulsion system for large marine vessels, such as submarines and other naval vessels, which operates at low noise levels and enables rapid stopping and direction reversal of the vessel.

In its broadest aspect the propulsion system includes an adjustable speed prime mover rotatable at least in one direction; a reversible drive mechanism driven by the prime mover and including a fluid-cooled torque converter and speed reduction means; an energy-dissipating load selectively connectable to the drive mechanism; and a propeller driven by the drive mechanism. The load is operable when connected during a reversing maneuver after the prime mover speed is slowed, to dissipate kinetic energy from the drive mechanism and the propeller. The fluid-cooled torque converter is operable during a reversing maneuver after the drive mechanism is placed in reverse and the load is disconnected. The prime mover and torque converter input speed is increased in said one direction of rotation while the torque converter output member is driven in reverse by the propeller as the ship moves in the original direction of travel, to dissipate kinetic energy from the propeller until propeller rotation and ship movement cease, whereupon the torque converter drives the ship in reverse.

Several specific embodiments of the invention are disclosed herein. In one system the torque converter itself is reversable during a reversing maneuver. In another, the speed reduction means is reversible during a reversing maneuver. In still another, the speed reduction means includes gears. In a preferred embodiment, the speed reduction means includes an electric alternator and a reversible electric motor driven by the alternator and the load includes dynamic braking electrical resistor means connectable to the alternator and motor to dissipate energy.

More specifically, in a preferred embodiment which is well-adapted for use on a nuclear powered submarine which is provided with a nuclear powered steam generating plant, the system comprises a prime mover in the form of an adjustable speed non-reversible steam turbine, a two-element (rotatable impeller and turbine elements) fluid-cooled hydraulic torque converter driven by the steam turbine, an electric alternator driven by the torque converter, a reversible electric motor powered by the alternator for driving the propeller, and an energy dissipating load means in the form of a dynamic braking water-cooled resistor bank selectively connectable to the alternator and motor. The steam turbine is provided with a throttle for adjusting turbine speed between idle and full speed. The resistor bank is connectable and disconnectable by means of a selectively operable dynamic braking contactor. The motor is reversibly connectable to the alternator by means of a selectively operable forward/reversing contactor.

In operation of the preferred embodiment, rapid direction reversal of the vessel is accomplished by throttling the steam turbine to idle, operating the dynamic brake contactor to connect the resistor banks to the alternator and motor and thereby absorb kinetic energy of the alternator, motor and propeller, operating the forward/reverse contactor when the system is at slow speed or rest to connect the motor for reversed operation, operating the dynamic brake contactor to disconnect the resistor bank and thereby allow the propeller being driven by vessel momentum to drive the motor, the alternator and the torque converter output rotatable element (i.e., turbine) in reverse, and increasing the steam turbine speed in the original direction of rotation to subsequently effect stopping and reversal of the propeller and the vessel, with the oil-cooled torque converter dissipating the heat generated by stopping and reversing the vessel.

A propulsion system in accordance with the invention offers numerous advantages over the prior art. For example, the absence of reduction gearing in one preferred embodiment reduces the noise signature. Rapid stopping and direction reversal are possible. Use of either a non-reversible main steam turbine or use of a reversible turbine which need be operated in only one direction of rotation is possible, thereby simplifying the turbine and the turbine controls and reducing costs. System simplification, space reduction, and cost reduction are afforded. Other objects and advantages will hereinafter appear.

DRAWINGS

DESCRIPTION OF PREFERRED EMBODIMENTS

Figure 1:
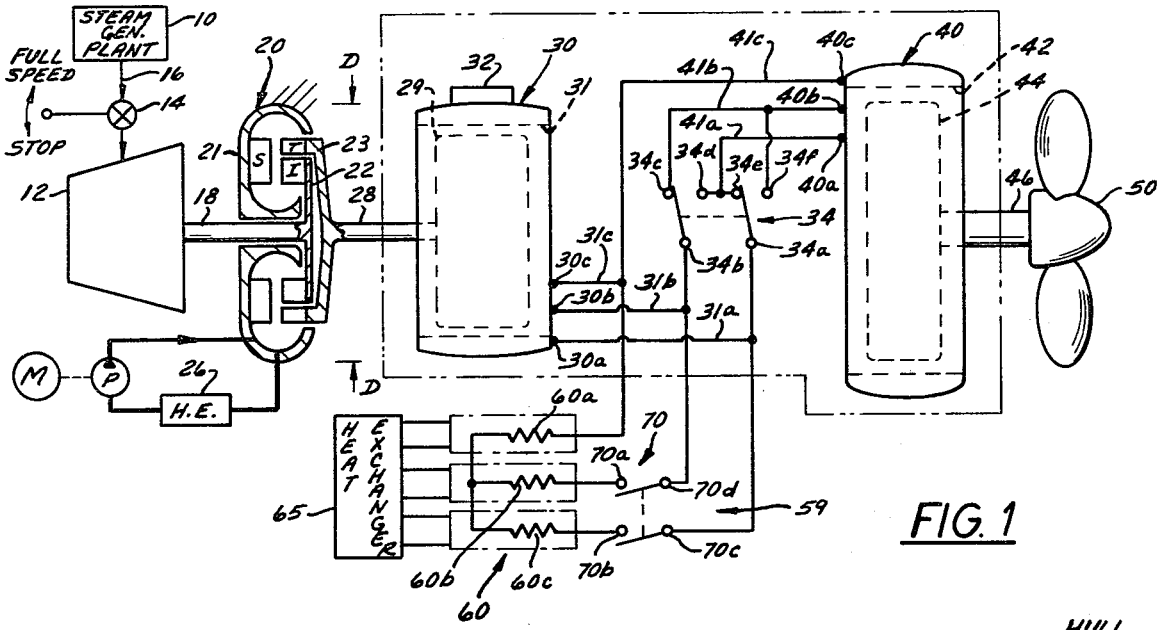
FIG. 1 is a schematic diagram of one preferred embodiment of a propulsion system in accordance with the invention.

Referring to FIG. 1, there is shown a propulsion system for a vessel (not shown), such as a submarine, which system operates at a low noise level and enables rapid stopping and direction reversal of the vessel. The system is especially well-adapted for use on a nuclear powered attack submarine which employs a nuclear powered steam generating plant 10 and a large steam turbine 12 serving as the prime mover for main propulsion, which must be able to stop and reverse within about five ship lengths, for example, and which must have a very low noise signature so as to avoid detection by underwater sound detection gear. However, the propulsion system could have other uses.

As FIG. 1 shows, the propulsion system comprises steam turbine 12 which is understood to be non-reversible and adjustable to desired speeds within a range between stop (or idle speed) and full speed (7000 r.p.m., for example) by means of an adjustable throttle valve 14 which is connected in a steam supply line 16 between steam generating plant 10 and steam turbine 12. Steam turbine 12 is rated at 46,500 h.p. maximum power output, for example.

Figure 4:
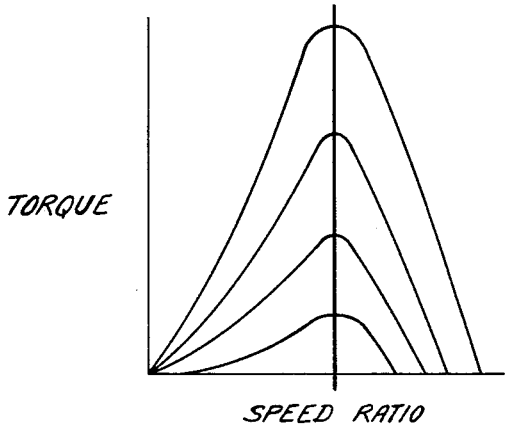
FIG. 4 is another graph depicting the constant speed ratio of the torque converter.

Steam turbine 12 is connected by a shaft 18 to drive a hydraulic oil-cooled torque converter 20 which comprises a stationary housing element 21, a first rotatable element or bladed impeller 22 which is connected to be driven by shaft 18, and a second rotatable element or bladed turbine 23. Torque converter 20 is designed to operate at peak efficiency at a single speed ratio of 0.33, with such single point of peak efficiency being, for example, a minimum of 81% and a maximum of 85% or higher. The torque capacity of torque converter 20 follows a conventional square speed/torque curve, as does a propeller 50, hereinafter described. FIG. 4 and the Chart I at the end of the present specification and show that the torque converter 20 maintains a nearly constant speed ratio and remains at a maximum peak efficiency design point as torque converter input speed and propeller demand vary. Torque converter 20, which for example has a circuit diameter D on the order of 26.4", functions to transmit power from turbine 12 to the rest of the propulsion system and also functions to absorb kinetic energy and dissipate it in the form of heat during the final phases of a stopping or reversing maneuver. In this regard, torque converter 20 is cooled by the hydraulic operating fluid which is circulated therethrough and through an external oil cooler or heat exchanger 26 during torque converter operation. As will be understood, oil cooler 26 is designed, connected and located on the submarine so as to transfer large amounts of heat rapidly and efficiently to the sea water surrounding the submarine. Oil circulated by a pump P driven by a motor M. The large amount of system heat loss or cooling effected by torque converter 20 and its oil cooler 26 is tolerable because use of the nuclear powered steam generating plant 10 tends to place lower emphasis on fuel efficiency.

It should also be noted that torque converter 20 in effect replaces or substitutes for the first reduction gearing which is employed in conventional submarine drive systems. Such gearing employs gear elements which operate in the highest speed range and produce the greatest noise signature, whereas torque converter 20 by its very nature and construction produces a very low noise signature even during high speed operation.

As FIG. 1 further shows, turbine 23 of torque converter 20 is connected by a shaft 28 to the rotor 29 of an electric alternator 30, which alternator further includes a two-pole stator 31 and a static exciter 32. Alternator 30 is, for example, on the order of 78" in diameter and rated at 2325 r.p.m. and designed to be 95% efficient. Alternator 30 has three electrical output terminals 30*a*, 30*b*, 30*c* to which electrical conductors 31*a*, 31*b*, 31*c*, respectively, are connected.

The conductors 31*a* and 31*b* are connected to the movable contacts 34*a* and 34*b*, respectively, of a forward/reverse electrical contactor 34 which, for example, is shown in the form of a double pole double throw switch. Contactor 34 includes a pair of "forward" contacts 34*c* and 34*d* and a pair of "reverse" contacts 34*e* and 34*f*, connected as hereinafter described. Contactor 34 is shown in "forward" position.

As FIG. 1 shows, the propulsion system further comprises an electric motor 40 which includes a stator 42 and a rotor 44. Motor 40 is, for example, on the order of 98" in diameter and takes the form of a reversible induction motor having 30 poles, rated at 115 r.p.m., and designed to be 95% efficient. The rotor 44 of motor 40 is connected by a shaft 46 to the propeller 50 which is designed to rotate and deliver 34,000 h.p. at 150 r.p.m. In FIG. 1, torque converter 20, alternator 30 and reversible motor 40 together provide or comprise a reversible speed reduction mechanism. Motor 40 has three electrical input terminals 40*a*, 40*b*, 40*c* to which electrical conductors 41*a*, 41*b*, 41*c*, respectively, are connected.

The conductor 41*a* is connected to the contacts 34*d* and 34*e* of reversing contactor 34. The conductor 41*b* is connected to contacts 34*c* and 34*f* of reversing contactor 34. The conductor 41*c* is connected to conductor 31*c* (i.e., terminal 30*c* of alternator 30).

As FIG. 1 shows, the propulsion system also comprises an energy dissipating load 59 which takes the form of a dynamic braking resistor bank 60 comprising a plurality of electrical resistors 60*a*, 60*b*, 60*c*, which have one side electrically connected to each other and which have their other sides connected as hereinafter described. The resistor bank 60 operates when connected during a reversing maneuver after the prime mover 12 is slowed to idle or stopped, to receive current flow from alternator 30 (and torque converter 20) and motor 40 (and propeller 50), which are still rotating because of kinetic energy therein, and to convert the electrical energy to heat which is dissipated to a water-cooled heat exchanger 65 which is associated with the resistor bank 60. Heat exchanger 65 is designed, connected and located on the submarine so as to transfer large amounts of heat rapidly and efficiently to the surrounding sea water.

Thus, the other side of resistor 60*a* is connected to conductors 31*c* and 41*c* hereinbefore described. The other sides of the resistors 60*b* and 60*c* are connected to the stationary contacts 70*a* and 70*b*, respectively, of a dynamic braking contactor 70 which, for example, is shown in the form of a double pole single throw switch. Contactor 70 includes a pair of movable contacts 70*c* and 70*d* which are connected to the movable contacts 34*a* and 34*b*, respectively, of reversing contactor 34 and also to conductors 30*a* and 30*b*, respectively, hereinbefore described. Contactor 70 is shown in open or disconnect position.

The propulsion system of FIG. 1 operates as follows.

Assume that non-reversible adjustable-speed steam turbine 12 is being supplied with steam from the steam plant 10 and throttle 14 is adjusted to provide for full speed. The oil-cooled hydraulic torque converter 20 is then driven by the steam turbine 12 at full speed. Alternator 30 is thus driven by the torque converter 20 at full speed and supplies maximum electric power at its output terminals 30*a*, 30*b*, 30*c* to the power input terminals 40*a*, 40*b*, 40*c* of the reversible induction motor so that the motor drives the propeller 50 at full speed. Further assume that forward/reverse contactor 34 is in "forward" position as shown in FIG. 1 and connecting the alternator 30 to the motor 40 to effect forward rotation of the motor and propeller 50 attached thereto. Also assume that dynamic brake contactor 70 is open and resistor bank 60 is disconnected.

With these assumptions, rapid direction reversal of the submarine from forward to stop to reverse is accomplished by adjusting throttle 14 to idle thereby throttling the steam turbine 12 to idle. Then, the dynamic brake contactor 70 is closed to connect the resistor bank 60 to the alternator 30 and motor 40 to thereby absorb the kinetic energy of the alternator, motor and propeller 50. Heat from the resistor bank 60 is dissipated by heat exchanger 65. When these components (and including torque converter turbine 23) of the system comes to slow speed or rest, the forward/reverse contactor 34 is placed in reverse to connect the motor 40 for reverse operation. The dynamic brake contactor 70 is then operated to disconnect the resistor bank 60. At this time, the ship is still moving forward (although slowing down) and the propeller 50 is being driven by ship momentum to drive the motor 40, which drives the alternator 30 and the torque converter rotatable element 23 in reverse. The throttle 14 is then adjusted or advanced from idle (or stop) to higher or full speed to drive turbine 12 toward full speed and cause impeller 23 of torque converter 20 to rotate at full speed. Energy absorption of the torque converter is principally provided as a retarder, but little power is required from the engine. Since the elements 22 and 23 of torque converter 20 are now rotating in opposite direction, energy from the forward momentum of the submarine is provided from propeller 50 to the torque converter 20 wherein it is converted to heat in the fluid, which heat is dissipated by heat exchanger 26. Thus, increasing the steam turbine speed enhances stopping and reversal of the propeller 50 and the submarine, with the oil-cooled torque converter 20 and heat exchanger 26 dissipating the heat generated by such stopping and reversing the submarine.

It is to be understood that a reversal maneuver while the submarine is moving in reverse to the forward direction is carried out in substantially the same manner as above-described.

Figure 2:
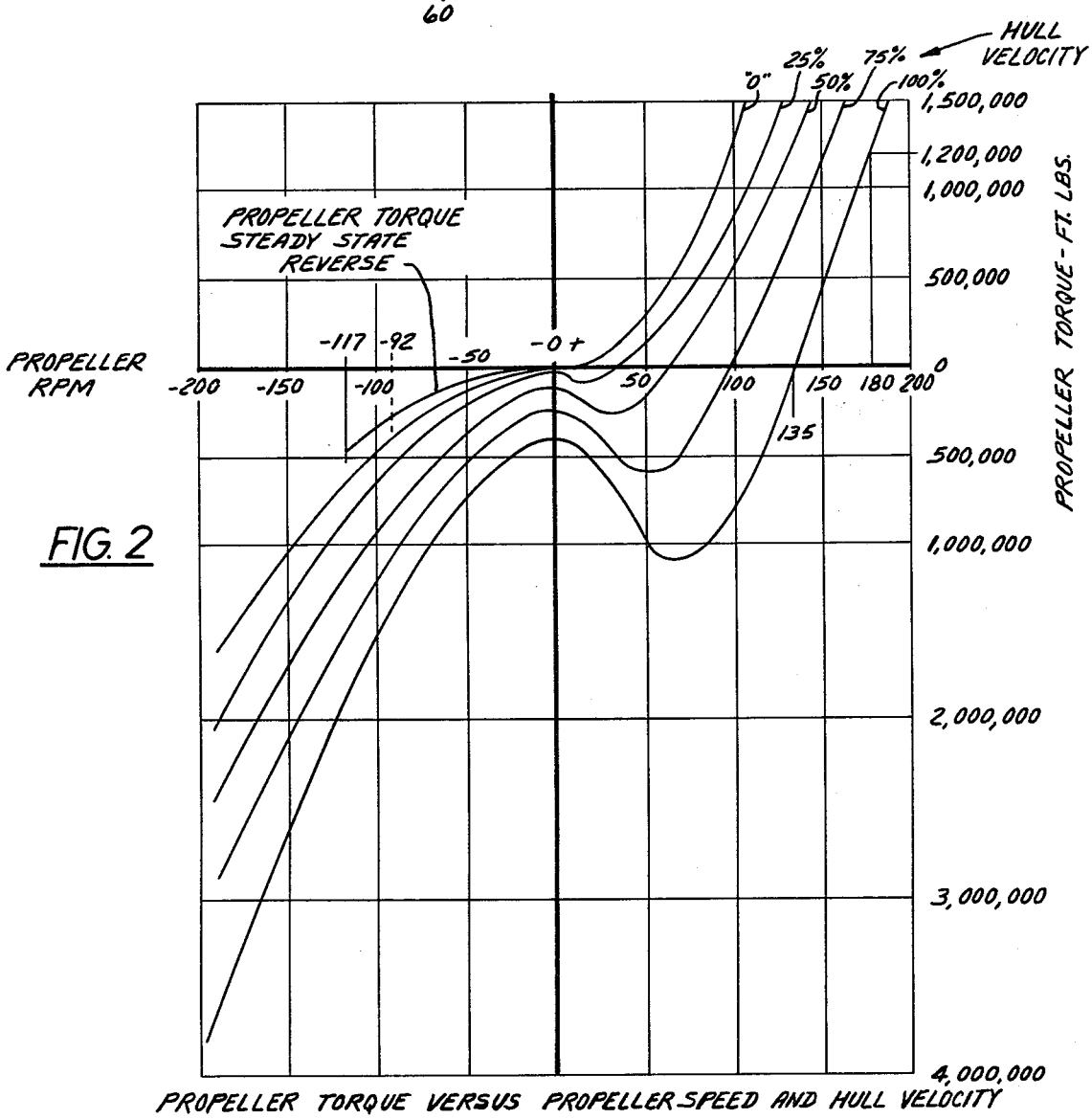
FIG. 2 is a graph wherein propeller torque is plotted against propeller r.p.m. for the system shown in FIG. 1.
Figure 3:
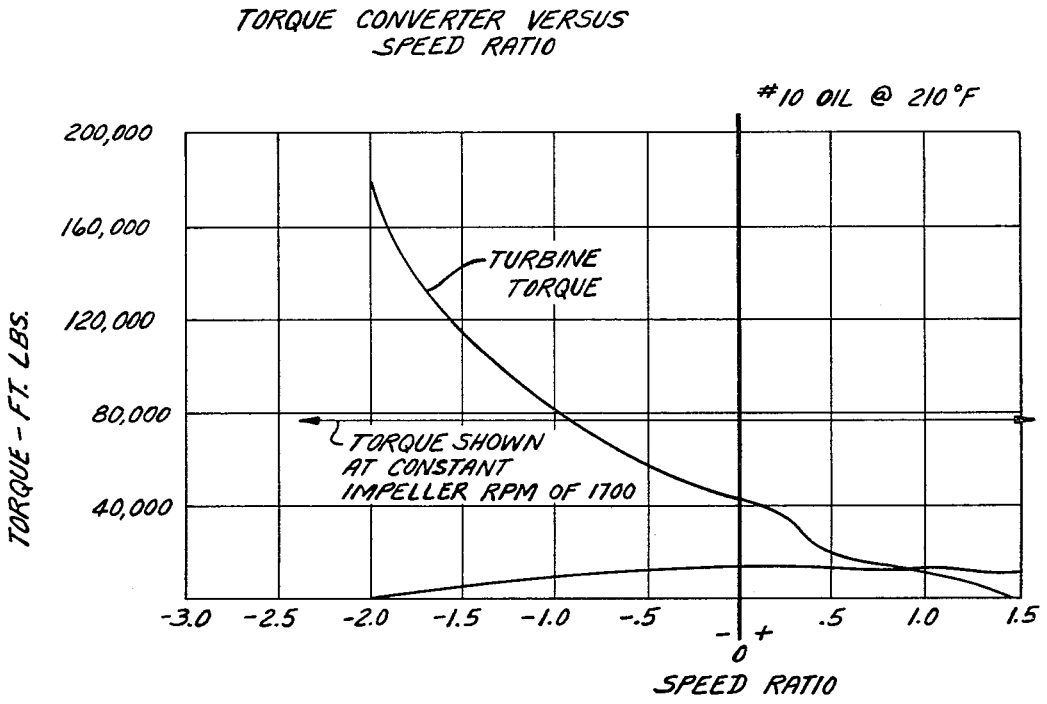
FIG. 3 is a graph wherein the torque converter characteristics of torque and speed ratio are plotted against each other for the system shown in FIG. 1.

The graphs in FIGS. 2, 3 and 4 and the Chart I at the end of this specification are self-explanatory in depicting typical performance characteristics under various operating conditions of the propulsion system and components thereof shown in FIG. 1.

Figure 5:
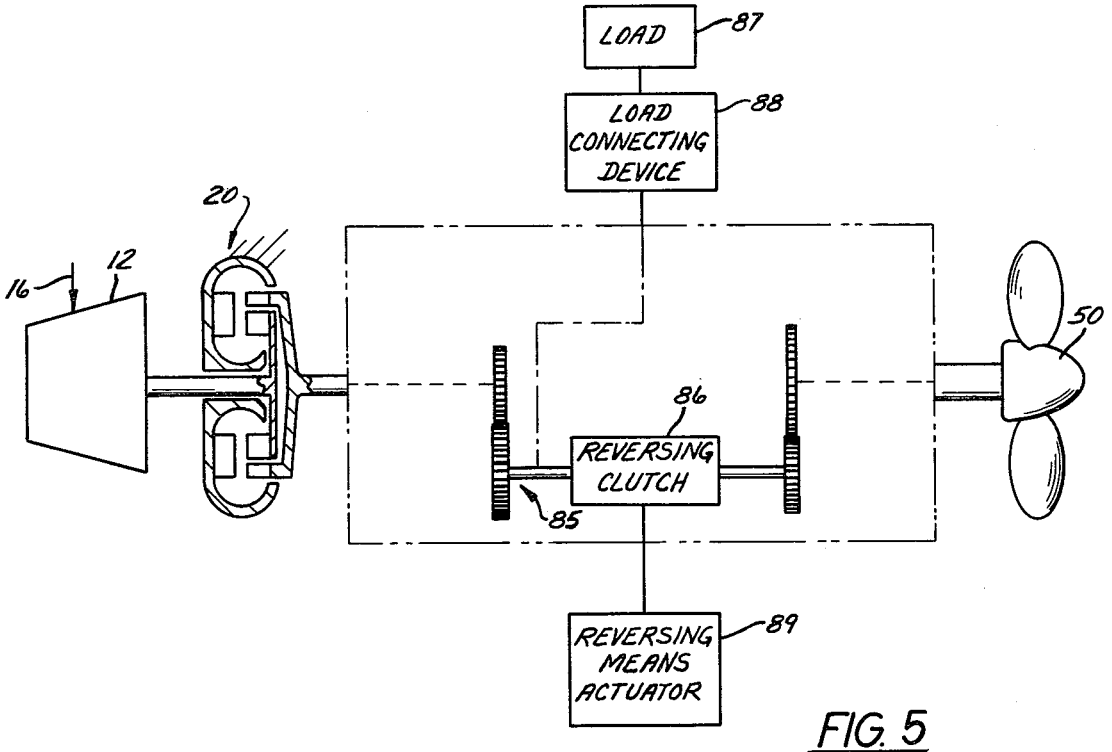
FIG. 5 is a schematic diagram of another embodiment of the invention.
Figure 6:
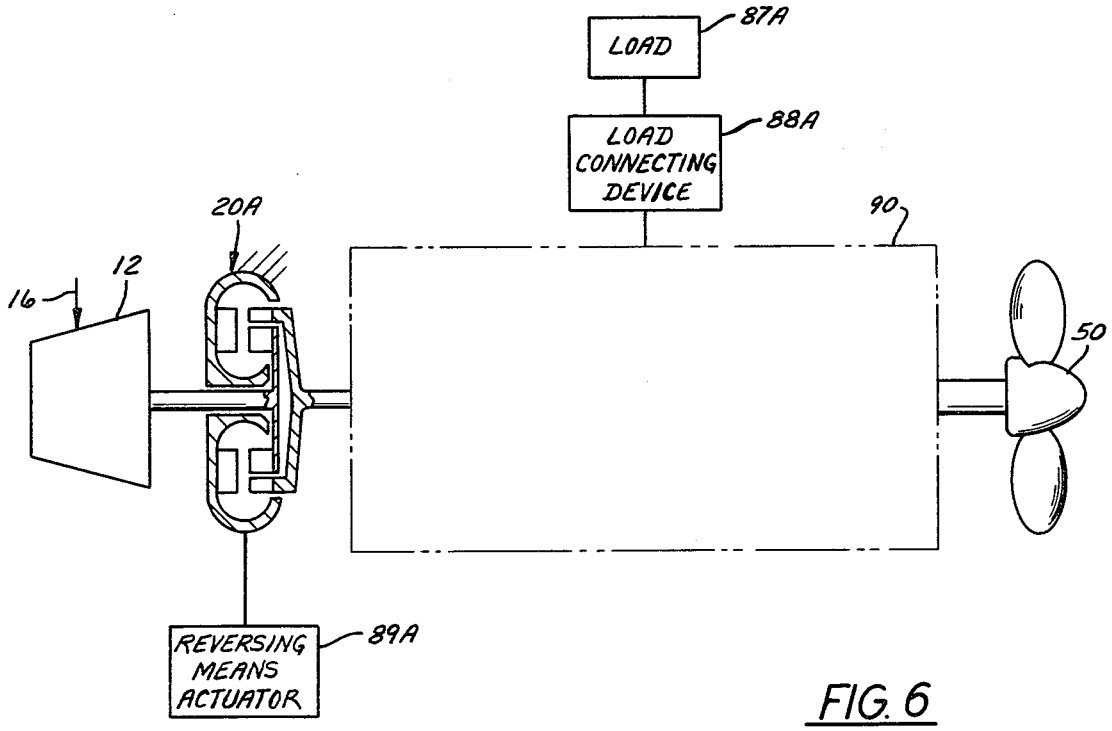
FIG. 6 is a schematic diagram of still another embodiment of the invention.

FIGS. 5 and 6 are schematic diagrams of other embodiments of a propulsion system in accordance with the invention wherein components similar to those shown and described in connection with FIG. 1 are designated by the same reference numerals. The systems in FIGS. 5 and 6 operate in a similar manner and produce similar results to that of FIG. 1.

In FIG. 5 the torque converter 20, a reduction gear train 85 and a reversing means 86, selectively operable by a reversing means actuator 89, comprise the reversible speed reduction mechanism. A load 87, which is connectable to gear train 85 by means of a load connecting device such as a selectively operable clutch 88, could be any suitable energy-absorbing and dissipating mechanical device or system such as, for example, a flywheel (not shown), a friction generating assembly and heat exchanger (not shown), or it could include an electrical generator and water-cooled resistor bank (not shown), or a hydrokinetic retarder (not shown).

The propulsion system shown in FIG. 5, although it includes a gear train 85, would not have as great a noise signature as conventional propulsion systems because the high speed first gear stage is effectively replaced by the torque converter 20.

In FIG. 6 the torque converter 20A, which is a reversible unit, and the components in that portion of the system designated 90 comprise the reversible speed reduction mechanism. The torque converter 20A is reversible as required by means of a selectively operable reversing actuator 89A. System portion 90 may include either the type of components such as the alternator 30 and motor 40 shown in FIG. 1 (in which case load 87A, connectable by a selectively operable load connecting device 88A in the form of a load break switch, is a resistor bank such as 60) or such as the reduction gear train 85 shown in FIG. 5 (in which case load 87A, connectable by device 88A in the form of a clutch is like load 87 described in connection with FIG. 5).

CHART I

| A Prop RPM | B Prop $HP_3$ $\left(\frac{A}{150}\right)^3 \times$ 34000 (Classic) | C Converter RPM A × 15.5 | D Converter Output HP $\frac{B}{.9}$ | E Converter Input HP $\frac{D}{.81}$ | F Converter Heat Loss HP E − D | G Converter Input RPM $\frac{C}{.33}$ | H Converter Input Torque $\left(\frac{G}{7000}\right)^2 \times$ 34896 | J Converter Input HP $\frac{G \times H}{5252}$ | E Compare to E |
|---|---|---|---|---|---|---|---|---|---|
| 150 | 34000 | 2325 | 37775 | 46635 | 8660 | 7000 | 34896 | 46510 | 46635 |
| 125 | 19675 | 1938 | 21860 | 26987 | 5127 | 5813 | 24064 | 26634 | 26987 |
| 100 | 10000 | 1550 | 11110 | 13716 | 2606 | 4655 | 15431 | 13676 | 13716 |
| 75 | 4250 | 1163 | 4722 | 5829 | 1107 | 3490 | 8674 | 5763 | 5829 |
| 50 | 1259 | 775 | 1400 | 1728 | 328 | 2327 | 3856 | 1708 | 1728 |
| 25 | 157 | 388 | 174 | 215 | 41 | 1163 | 963 | 213 | 215 |

I claim:

1. In a propulsion system operable to effect a rapid reversal maneuver of a ship:

an adjustable speed prime mover rotatable in at least one direction;

a reversible drive mechanism driven by said prime mover and including a fluid-cooled torque converter and speed reduction means;

a propeller driven by said drive mechanism; and energy-dissipating load means operable during a reversing maneuver after said prime mover speed is slowed, to dissipate kinetic energy from said drive mechanism and said propeller;

said fluid-cooled torque converter being operable during a reversing maneuver after said energy dissipating load means has operated to dissipate kinetic energy and said drive mechanism is placed in reverse, and while said prime mover speed is being increased in said one direction of rotation, to be driven in reverse by said propeller while said ship moves in the original direction of travel, and to dissipate kinetic energy from said propeller until propeller rotation and ship movement cease, whereupon said torque converter drives said ship in reverse.

2. A propulsion system according to claim 1 wherein said torque converter is reversible during a reversing maneuver.

3. A propulsion system according to claim 1 wherein said speed reduction means is reversible during a reversing maneuver.

4. A propulsion system according to claim 1 wherein said speed reduction means includes gears.

5. A propulsion system according to claims 1 or 2 or 3 wherein said speed reduction means includes an electric alternator and an electric motor driven by said alternator and wherein said energy-dissipating load means includes electrical resistor means connectable to said alternator and motor.

6. A propulsion system according to claim 1 wherein said speed reduction means includes an electric alternator and a reversible electric motor driven by said alternator and wherein said energy-dissipating means includes electrical resistor means connectable to said alternator and motor.

7. In a propulsion system operable to effect a rapid reversal maneuver of a ship:

an adjustable speed prime mover rotatable in at least one direction;

a reversible drive mechanism driven by said prime mover and including a fluid-cooled torque converter and speed reduction means;

an energy-dissipating load selectively connectible to said drive mechanism; and a propeller driven by said drive mechanism;

said load being operable when connected during a reversing maneuver after said prime mover speed is slowed, to dissipate kinetic energy from said drive mechanism and said propeller;

said fluid-cooled torque converter being operable during a reversing maneuver after said load is disconnected and said drive mechanism is placed in reverse, and while said prime mover speed is being increased in said one direction of rotation, to be driven in reverse by said propeller while said ship moves in the original direction of travel, and to dissipate kinetic energy from said propeller until propeller rotation and ship movement cease, whereupon said torque converter drives said ship in reverse.

8. A propulsion system according to claim 7 wherein said torque converter is reversable during a reversing maneuver.

9. A propulsion system according to claim 7 wherein said speed reduction means is reversible during a reversing maneuver.

10. A propulsion system according to claim 7 wherein said speed reduction means includes gears.

11. A propulsion system according to claims 7 or 8 or 9 wherein said speed reduction means includes an electric alternator and an electric motor driven by said alternator and wherein said load includes electrical resistor means connectable to said alternator and motor.

12. A propulsion system according to claim 7 wherein said speed reduction means includes an electric alternator and a reversible electric motor driven by said alternator and wherein said load includes electrical resistor means connectable to said alternator and motor.

13. In a propulsion system operable to effect a rapid reversal maneuver of a ship powered by a steam generating plant:

an adjustable speed steam turbine supplied with steam from said plant and rotatable in at least one direction;

a fluid-cooled torque converter driven by said steam turbine;

an electric alternator driven by said torque converter;

a reversible electric motor connectable to be supplied with electric power from said alternator;

a fluid-cooled electrical resistance load selectively connectable to said alternator and said motor; and a propeller driven by said electric motor;

said resistance load being operable when connected during a reversing maneuver after said steam turbine speed is slowed, to dissipate kinetic energy from said alternator and said motor;

said fluid-cooled torque converter being operable during a reversing maneuver after said resistance load is disconnected and said motor is connected in reverse, and while the steam turbine speed is being increased in said one direction of rotation, to be driven in reverse by said propeller while said ship moves in the original direction of travel, and to dissipate kinetic energy from said propeller until propeller rotation and ship movement cease, whereupon said torque converter drives said ship in reverse.

14. A propulsion system according to claim 13 further including a selectively operable throttle for adjusting the speed of said steam turbine;

a selectively operable reversing contactor for connecting said motor to said alternator for forward or reverse rotation; and a selectively operable dynamic braking contactor for connecting and disconnecting said electrical resistance load.

15. A propulsion system according to claim 14 wherein said fluid-cooled torque converter and said fluid-cooled electrical resistance load are each provided with a water-cooled heat exchanger.

16. In a propulsion system operable to effect a rapid reversal maneuver of a ship powered by a steam generating plant:

an adjustable speed steam turbine supplied with steam from said plant and rotatable in at least one direction;

a fluid-cooled torque converter driven by said steam turbine;

reversible speed reduction means including gears driven by said torque converter;

an energy-dissipating load selectively connectable to said reversible speed reduction means; and a propeller driven by said reversible speed reduction means;

said load being operable when connected during a reversing maneuver after the steam turbine speed is slowed, to dissipate kinetic energy from said reversible speed reduction means and said propeller;

said fluid-cooled torque converter being operable during a reversing maneuver after said load is disconnected and said reversible speed reduction means is placed in reverse, and while the steam turbine speed is being increased in said one direction of rotation, to be driven in reverse by said propeller while said ship moves in the original direction of travel, and to dissipate kinetic energy from said propeller until propeller rotation and ship movement cease, whereupon said torque converter drives said ship in reverse.

17. A propulsion system according to claim 16 further including a selectively operable throttle for adjusting the speed of said steam turbine;

a selectively operable reversing clutch for connecting said gears in said speed reduction means for forward or reverse rotation; and a selectively operable braking clutch for connecting and disconnecting said load to said gears.

18. A propulsion system according to claim 17 wherein said fluid-cooled torque converter and said energy-dissipating load are each provided with a water-cooled heat exchanger.

19. In a propulsion system operable to effect a rapid reversal maneuver of a ship powered by a steam generating plant;

an adjustable speed steam turbine supplied with steam from said plant and rotatable in at least one direction;

a reversible fluid-cooled torque converter driven by said steam turbine;

speed reduction means including gears driven by said torque converter;

an energy-dissipating load selectively connectable to said speed reduction means; and a propeller driven by said speed reduction means;

said load being operable when connected during a reversing maneuver after the steam turbine speed is slowed, to dissipate kinetic energy from said speed reduction means and said propeller;

said fluid-cooled torque converter being operable during a reversing maneuver after said load is disconnected and said torque converter is placed in reverse, and while steam turbine speed is being increased in said one direction of rotation, to be driven in reverse by said propeller while said ship moves in the original direction of travel, and to dissipate kinetic energy from said propeller until propeller rotation and ship movement cease, whereupon said torque converter drives said ship in reverse.

20. A propulsion system according to claim 19 further including a selectively operable throttle for adjusting the speed of said steam turbine;

a selectively operable reversing means for operating said torque converter for forward or reverse rotation; and a selectively operable braking clutch for connecting and disconnecting said load to said gears.

21. A propulsion system according to claim 20 wherein said fluid-cooled torque converter and said fluid-cooled energy-dissipating load are each provided with a water-cooled heat exchanger.

* * * * *